US009084502B2

(12) United States Patent
Lapadula

(10) Patent No.: US 9,084,502 B2
(45) Date of Patent: Jul. 21, 2015

(54) QUICK FASTENING ASSEMBLY

(71) Applicant: Paul Lapadula, Brown Mills, NJ (US)

(72) Inventor: Paul Lapadula, Brown Mills, NJ (US)

( * ) Notice: Subject to any disclaimer, the term of this patent is extended or adjusted under 35 U.S.C. 154(b) by 0 days.

(21) Appl. No.: 13/755,249

(22) Filed: Jan. 31, 2013

(65) Prior Publication Data

US 2014/0209257 A1 Jul. 31, 2014

(51) Int. Cl.
*A47H 19/00* (2006.01)

(52) U.S. Cl.
CPC ..... *A47H 19/00* (2013.01)

(58) Field of Classification Search
CPC ..... A47H 19/00
USPC ..... 160/349.1, 349.2, 38; 24/16 R, 306, 24/703.1; 248/206.5, 315, 499
See application file for complete search history.

(56) References Cited

U.S. PATENT DOCUMENTS

| | | | | | |
|---|---|---|---|---|---|
| 882,057 | A | * | 3/1908 | Forte | 441/90 |
| 1,344,233 | A | * | 6/1920 | Kinikin | 24/343 |
| 1,377,066 | A | * | 5/1921 | Garrabrant | 24/1 |
| 1,654,002 | A | * | 12/1927 | Kleinhamer | 160/349.2 |
| 1,741,182 | A | * | 12/1929 | Boye | 24/327 |
| 1,882,527 | A | * | 10/1932 | Stanley | 24/1 |
| 1,917,828 | A | * | 7/1933 | Coen | 160/108 |
| 2,365,664 | A | * | 12/1944 | Troensegaard et al. | 160/349.2 |
| 2,391,205 | A | * | 12/1945 | Van Cleeff | 160/349.2 |
| 2,403,361 | A | * | 7/1946 | Hagen | 160/349.2 |
| 2,498,925 | A | * | 2/1950 | Lind | 160/348 |
| 2,563,306 | A | * | 8/1951 | Burrage | 160/349.2 |
| 2,584,635 | A | * | 2/1952 | Spiegel et al. | 160/349.2 |
| 2,611,428 | A | * | 9/1952 | Van Cleeff | 160/349.2 |
| 2,836,181 | A | * | 5/1958 | Tapp | 606/155 |
| 3,086,265 | A | * | 4/1963 | Orenick et al. | 24/30.5 P |
| 3,409,224 | A | * | 11/1968 | Harp et al. | 239/33 |
| 3,467,427 | A | * | 9/1969 | Moberg | 292/322 |
| 3,754,589 | A | * | 8/1973 | Heimberg et al. | 160/349.2 |
| 4,278,714 | A | * | 7/1981 | Schwartz | 428/4 |
| 4,963,410 | A | * | 10/1990 | Bryant | 428/100 |
| 6,244,326 | B1 | * | 6/2001 | Grieco | 160/349.2 |
| 6,705,380 | B2 | * | 3/2004 | Scolletta | 160/349.2 |
| 7,000,674 | B1 | * | 2/2006 | Johnson | 160/349.2 |
| 7,185,378 | B2 | * | 3/2007 | Smith | 5/642 |
| 8,042,232 | B2 | * | 10/2011 | Mask et al. | 24/16 R |

(Continued)

FOREIGN PATENT DOCUMENTS

| | | |
|---|---|---|
| JP | 10201607 | 1/1997 |
| JP | 2006130130 | 11/2004 |

(Continued)

*Primary Examiner* — Katherine Mitchell
*Assistant Examiner* — Justin Rephann
(74) *Attorney, Agent, or Firm* — Emmett S. Collazo, Esq.

(57) ABSTRACT

A fastening assembly for managing and statically positioning or holding objects, and for other uses, the fastening assembly comprising a flexible, corrugated tube, the tube having a first end and a second end, the first and second ends having an attachment mechanism, for example, male and female hook and loop ends (a mechanism commonly referred to by the trademark "Velcro"), which hook and loop ends are capable of being attached to each other to secure the ends of the tube to encompass various objects. The corrugated tube is extendable and condensable, and is allowed to encompass and detachably hold together curtains, drapes, towels, cords, wires, tubes of varying widths carrying liquid or air, lines, strings, or similar groupings of products having length where an advantage exists in collecting, coalescing, binding, and fastening a single product or a grouping of products.

9 Claims, 5 Drawing Sheets

(56) References Cited

U.S. PATENT DOCUMENTS

| | | | | |
|---|---|---|---|---|
| 8,316,515 | B2 * | 11/2012 | Slank | 24/306 |
| 8,375,523 | B2 * | 2/2013 | Pilon et al. | 24/16 PB |
| 2004/0194899 | A1 * | 10/2004 | Fudge | 160/349.2 |
| 2010/0237204 | A1 * | 9/2010 | Huang | 248/118 |
| 2012/0138245 | A1 * | 6/2012 | Affonso | 160/349.2 |

FOREIGN PATENT DOCUMENTS

| | | |
|---|---|---|
| JP | 2007236898 | 9/2007 |
| JP | 2012165993 | 2/2011 |

* cited by examiner

QUICK FASTENING ASSEMBLY

This application claims the benefit of U.S. Provisional Application No. 61/632,854, filed Feb. 1, 2012, the disclosures of which are incorporated herein by reference.

REFERENCES

U.S. Patent Documents

| | |
|---|---|
| U.S. Pat. No. 6,244,326 B1 | Grieco; Angelina |
| U.S. Pat. No. 3,754,589 A | Heimberg; Eli et al. |
| U.S. Pat. No. 2,584,635 A | Lawrence Spiegel et al. |
| U.S. Pat. No. 2,563,306 A | Burrage Philip A |
| U.S. Pat. No. 2,498,925 A | Lind Signe A |
| U.S. Pat. No. 2,403,361 A | John Hagen |
| U.S. Pat. No. 2,391,205 A | Cleeff Robert S Van |
| US 20120138245 A1 | Affonso; Mauricio |
| US 20040194899 A1 | Fudge, Wendy |
| U.S. Pat. No. 1,917,828 A | Coen Maggie L |

Foreign Patent Documents

| | |
|---|---|
| JP 2012165993 A | Fujita T |
| JP 2007236898 A | Kusafuka, Miho |
| JP 2006130130 A | Tanaka, Tsugunori |
| JP 10201607 A | Nojiri M et al. |

BACKGROUND OF THE INVENTION

Innovations for tie backs, holders, and window covering straps exist in the prior art. Even though these innovations may be useful for specific individual purposes which they address, they differ from the instant innovation, which possesses benefits over the prior art.

A first example is U.S. Pat. No. 6,244,326 B1, to Grieco, which teaches a device for tying back a group consisting of curtains, draperies, decorations, towels and vertical blinds to a wall, comprising a thin strap with a curtain facing side and an ambient facing side, and further comprising an end which must be attached to a wall. The use of hook and loop materials to attach the product to a wall is disclosed. The strap being made of flexible plastic for encircling the group is also disclosed.

A second example is found in Japanese patent disclosure 2006 130130 by Tsugunori, which uses a belt to tie back curtains by attaching magnets to both sides of the belt. The tie back ties a curtain to side parts of a window. Separate tying magnets and tying members are disclosed.

A third example is U.S. patent application Ser. No. 12/960,146, which discloses a drapery holdback device comprising a flexible body having a first ply and a second ply, and a first and a second end containing a first and a second magnet, respectively, and where the magnets are engaged through curtain or drapery materials.

In the prior art, most curtain holders need to be nailed, hooked, or pinned to a wall or window or door trim. The prior art identifies few uses of elastics to hold together drapes or curtains. The prior art identifies few uses of magnets. The prior art describes fastener products which have elastic pieces used as skeletons for the fastening apparatus.

SUMMARY OF THE INVENTION

The present invention relates to a fastening assembly for collecting, managing, and statically controlling curtains, draperies, decorations, towels, blinds, or groupings of wires, tubes, cords, ropes, fibers, strings, or lines.

It is an object of the present invention to provide a device that is extendable and condensable. It is a further object of the present invention to provide a device that is flexible while being extendable and condensable. It is a still further object of the present invention to provide a device that has the foregoing properties while being able to hold cords, drapes, curtains, ropes, wires, tubes containing liquids or air, or other products generally in the shape of cords, or collectable objects like drapes, curtains, or towels, without the need for using screws, nails, hook-eyes, or other wall- or surface-mounted accessories. It is a further object of the present invention to optionally meet the foregoing goals without use of, and without creating, a choking hazard for children. It is another object of the present invention to create a product having the foregoing characteristics which may draw back drapes or curtains at various positions in front of a window, so the curtains, drapes, wires, tubes, or other products, do not need to be fixed to one central location. For example, curtains may be collected and encompassed in the center, or optionally to one side of the location from which curtains, drapes, or wires, hang. It is a still further object of the present invention to provide a device which is efficient and advantageous for manufacturers to produce due to a low cost of manufacturing the invention. It is a still further object of the present invention to provide a fastener product which may be suitable for various aesthetic tastes and alternative embodiments due to the use of sleeves which may incorporate various logos and designs to meet consumers' tastes, to include seasonal, holiday, and sports designs, and may be adapted to be used for crafts projects for adults and children. It is a further object of the present invention to allow the air in the tube to vent through holes in the ends, which venting prevents a vacuum, or air build-up, during expansion and retraction of the tube. It is a further object of the present invention to provide a fast way to secure curtains or other groupings of wires, tubes, or similar products.

These and other objects and advantages of the present invention will be readily appreciable from the descriptions of the preferred embodiment and alternative embodiments of the invention, from the accompanying drawings, from the remainder of the specification, and from the claims.

BRIEF DESCRIPTION OF THE DRAWINGS

FIG. 2 further depicts that the fastening assembly may hold an object, such as curtains, drapes, or towels, at various angles to the wall, and due to friction, overcomes the force of gravity on the curtain.

DETAILED DESCRIPTION OF A PREFERRED EMBODIMENT OF THE INVENTION

Figure 1:
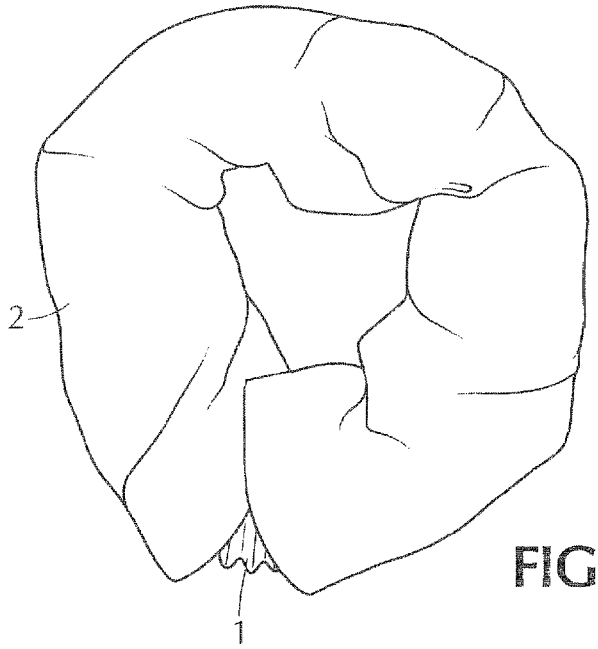
FIG. 1 is a depiction of a corrugated fastening assembly housed inside a cloth sleeve, where the fastening assembly creates a circular shape useful for holding materials within the encompassing assembly.
Figure 2:
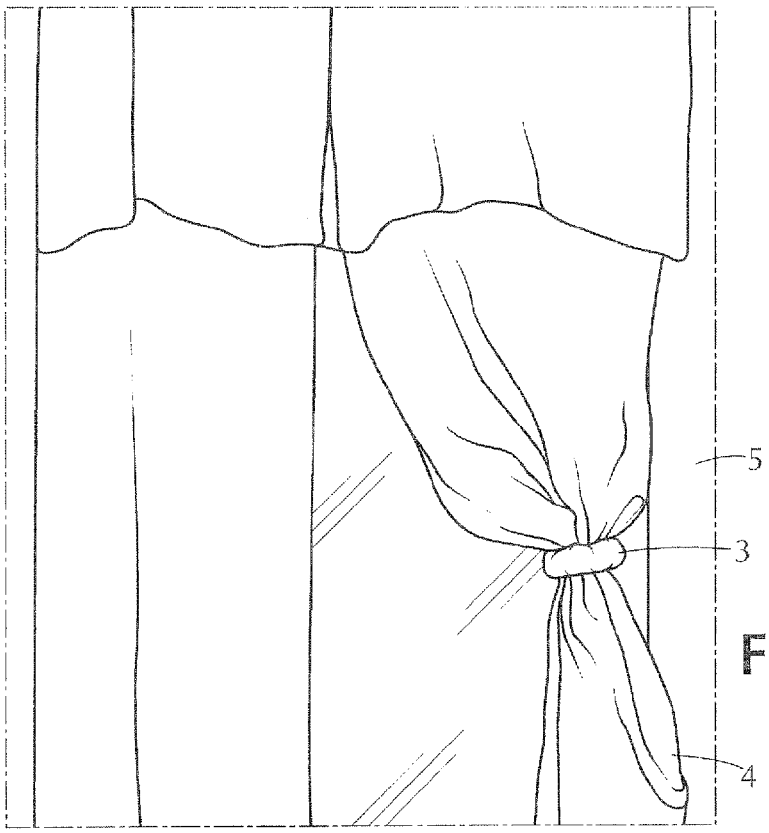
FIG. 2 is a depiction of the fastening assembly, including a sleeve, where this fastening device holds together a curtain, and which fastening device does not need to be attached to a wall.
Figure 3:
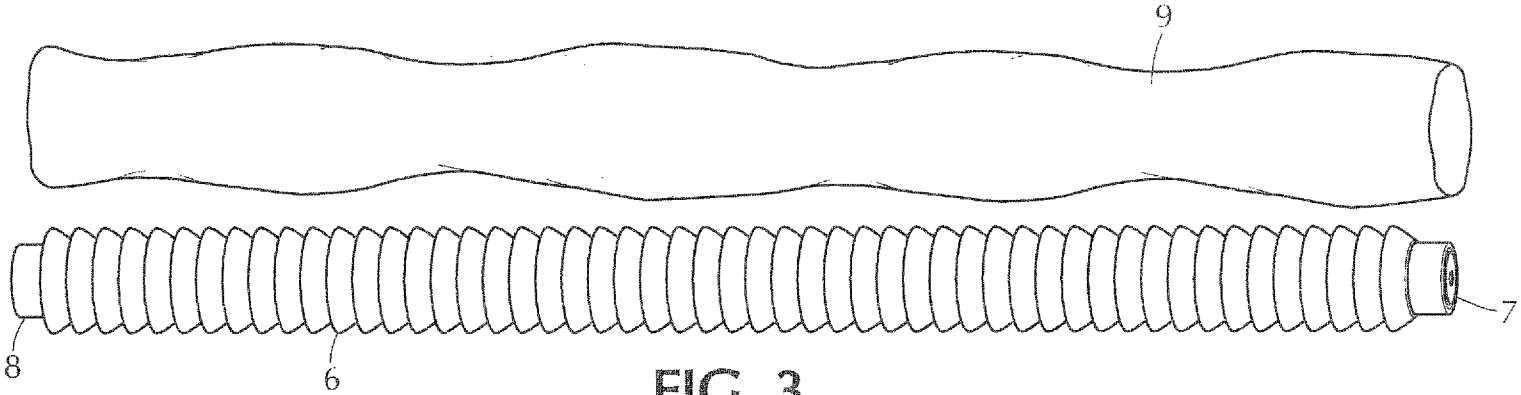
FIG. 3 is a depiction of a corrugated tube alongside a sleeve which may optionally be comprised of cloth or other material.
Figure 4:
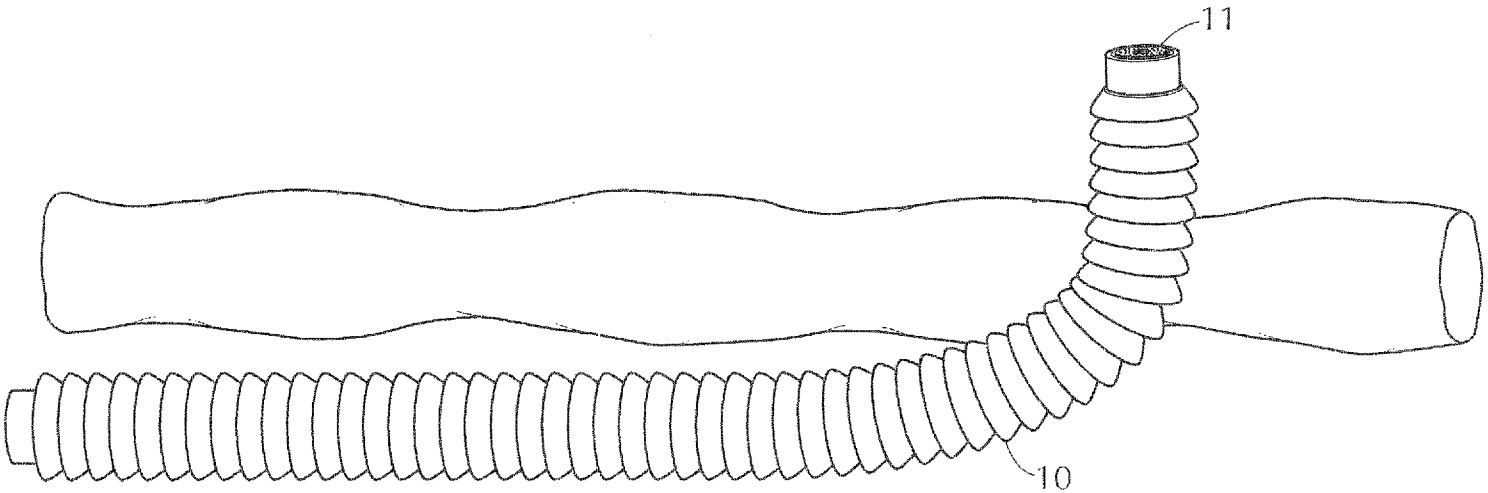
FIG. 4 is a depiction of a corrugated tube bent and held into position due to the properties intrinsic in the corrugated tube.
Figure 5:
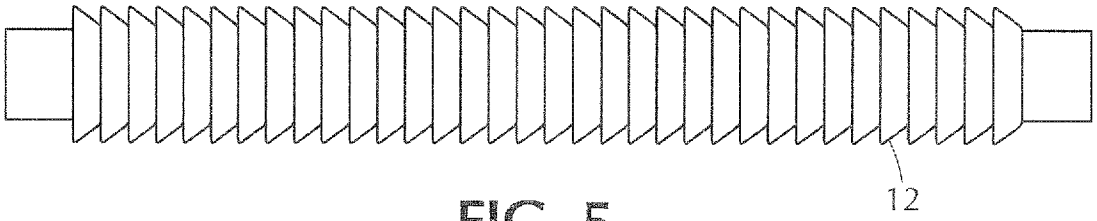
FIG. 5 is another depiction of a corrugated tube, which tube may be condensed, as depicted in FIG. 6.
Figure 6:
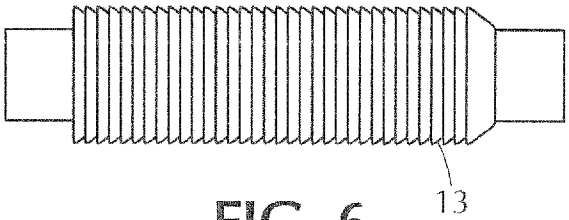
Figure 7:
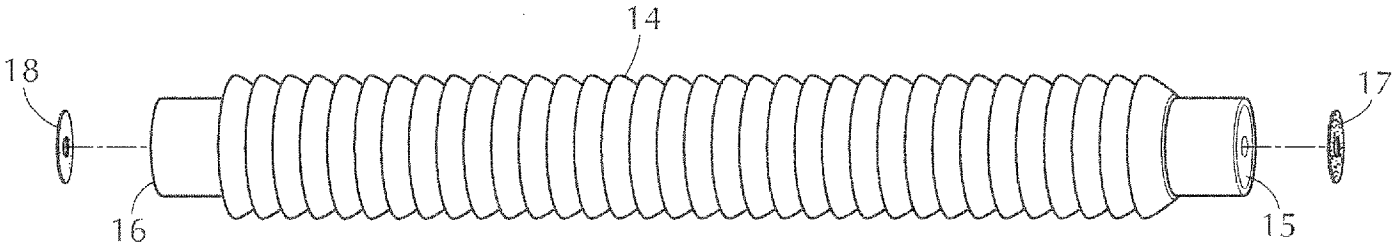
FIG. 7 depicts the ends of the tube, emphasizing the characteristic that the tubes may have circular holes in the ends, which allows for airflow into and out of the corrugated tube, aiding compression and expansion of the tube for encompassing various-sized objects.
Figure 8:
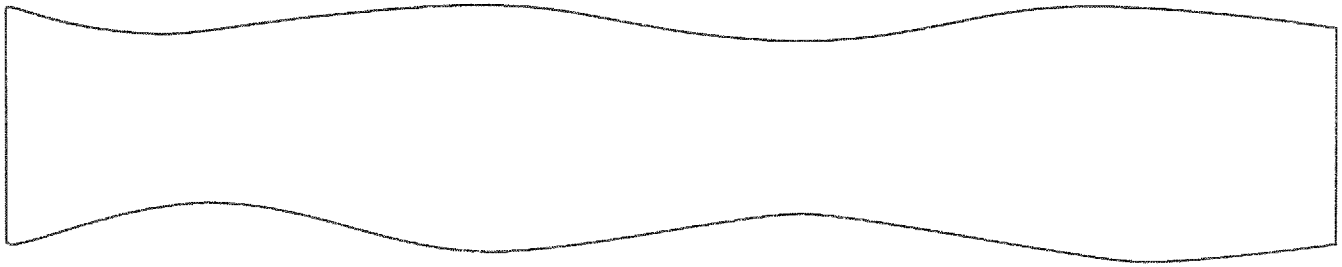
FIG. 8 is a depiction of a sleeve.
Figure 9:
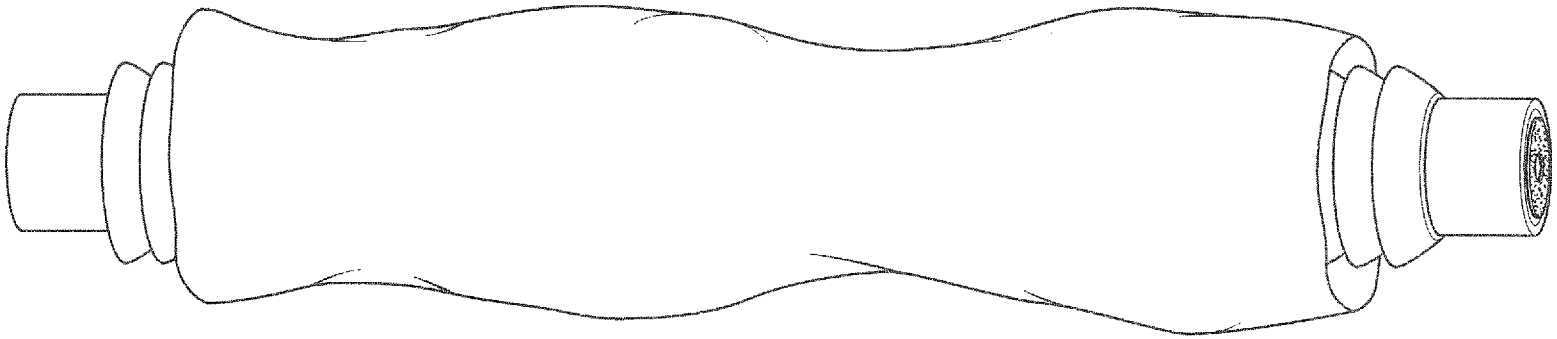
FIG. 9 is a depiction of the fastening assembly with the sleeve on the corrugated tube, and with a hook and loop attachment mechanism attached to the ends of the assembly.

FIG. 1 shows an assembly of a corrugated tube 1 with a sleeve 2 surrounding the corrugated tube. FIG. 1 represents an embodiment of the present invention where the assembly may optionally be collapsed to statically hold a curtain, drape, towel, or grouping of wires, tubes, or other products. FIG. 2 depicts the assembly 3 encompassing a curtain 4 and holding the curtain to one side of a window or door, while not being nailed or otherwise directly attached to a wall 5 or other surface.

In one embodiment of the invention, the outer diameter of the corrugated cylindrical tube 6 is one and one quarter (1.25) inches, where caps 7, 8 are placed over the ends of the tube. An eighteen-inch long cylindrical sleeve 9 made of cloth of any color, or pattern, may slide over the corrugated plastic tube. The tube is bendable 10, 11. The tube 12 is collapsible 13 to a length of, for example, 6 (six) inches, and expandable 12, 14 to a length of about eighteen (18) inches. To affix the assembly to a curtain, or similar object or grouping of objects, the device can, optionally, be condensed longitudinally 13, which allows the fastener assembly to encompass and hold a curtain or grouping of tubes or wires, for example, from unfurling, unfolding, or separating, from a preferred and static position. The end caps of the corrugated tube 15, 16 are designed to hold an attachment mechanism. In one embodiment, the holes in the end caps 15, 16 and hook and loop attachments 17, 18 (commonly referred to as "Velcro", as noted above, and typically made from nylon and polyester), may be attached to end caps 15, 16. In one embodiment, holes in the end caps 15, 16, and hook and loop attachments 17, 18 are about one-eighth (⅛) of an inch in diameter, allowing for venting of air during attachment and detachment of the assembly's ends 17, 18. Venting of air similarly occurs during longitudinal expansion or collapsing of the corrugated tube 6, 12, 13 and the fastening assembly as a whole. An additional embodiment exists where holes exist not in the longitudinal ends of the corrugated tube, but rather one, two, or multiple holes may exist in the side of the tube, for example, adjacent to the end cap, or in the corrugated areas of the corrugated tube.

One mechanism for using the present invention comprises expanding the tube 6, placing the sleeve over the tube 9, grasping one panel of a curtain 4, wrapping the tube with sleeve around the curtain and closing the loop by connecting it to the opposite end of the tube to form the assembly in FIG. 1. The curtain is adjusted for aesthetic preferences and the assembly may be collapsed while in the positioning of FIG. 1, allowing a curtain, for example, to be draped to a desired distance to the right FIG. 2 or the left of a window. FIG. 1. Examples of the attachment mechanism include but are not limited to the hook and loop attachment mechanism 17, 18, magnets, ties, and overlapping flaps. The corrugated tubing 6, 12, 13, end caps 15, 16, hook and loop mechanisms 17, 18, and sleeve 9, may be in predetermined sizes and diameters. In one embodiment, the present invention may be made in smaller sizes, both shorter in length and optionally smaller in circumference, for holding long hair for men and women, for thinner (i.e., shallower) or narrower curtains or drapes. Alternatively, for wider or thicker curtains, drapes, or towels, or larger groupings of wires, strings, tubes, or similar groupings of products, the present invention may be made in larger sizes, both in length and optionally in circumference. Additionally, to change the force required for detaching the assembly, the number of loops per square inch may be increased or decreased, or optionally the thickness of loops themselves may be increased or decreased, or both.

When the fastener assembly encompasses an object, forming a closed loop, a user may quickly reduce or lengthen the assembly in the fastening process, thereby decreasing or increasing the diameter of the fastener assembly 1. The decreasing or increasing of the fastener assembly occurs because the corrugated tube is condensable or expandable along the longitudinal axis, and the rigid or semi-rigid material holds its shape in the configuration to which it is manipulated. The internal diameter of the corrugated tubing itself, is not reduced. The holes in the end caps 15, 16 and hook and loop attachment mechanism 17, 18 allow air to escape, or vent. The first air passes through these holes 15, 16, 17, 18, at opposite ends of the corrugated tube, and the air then passes through the hook and loop material itself. Optionally, holes may be placed in the tube either instead of, or alternatively in addition to, the holes in the end caps, for venting during expansion or collapsing of the tube.

The corrugated tube 6, 12, 13, and thus the fastening assembly as a whole, is designed to allow for repeated expansion and collapsing. The assembly 1 is designed to allow for repeated detaching and re-attaching.

The hook and loop ends 17, 18 may be attached to end caps 15, 16 through use of, for example, adhesives, extrusion, sewing, or friction. The end caps 15, 16 may be affixed through use of, for example, adhesives, extrusion, sewing, heat, or friction. The attachment mechanisms, for example hook and latch 17, 18, magnetic ends, ties, overlapping flaps, may be affixed to the corrugated tube end caps 15, 16 through use of, for example, adhesives, extrusion, sewing, heat, or friction.

The fastening assembly can be used in the hotel industry for curtains, drapes, towels, or cords, in electronics and business industries for wires or cords. An additional use of the assembly is for the medical industry, where sterile sleeves may be used in fastening a number of cords, wires, or tubes, which tubes may be carrying liquid or air products, to other cords, wires or tubes, or possibly to attach an object or grouping of objects to a stationary object.

Although the present invention has been described in relation to particular embodiments thereof, many other variations and modifications and other uses will become apparent to those skilled in the art. Therefore, the present invention is to be limited not by the specific disclosure herein, but only by the appended claims and equivalents thereof.

What is claimed is:

1. A fastening assembly comprising:

a flexible member that is both longitudinally expandable and longitudinally collapsible, which member is also capable of holding its shape in a configuration to which it is manipulated and which member has first and second longitudinal ends, the first and second longitudinal ends comprising a first planar end surface and a second planar end surface, respectively;

the flexible member comprised of a corrugated tube;

the flexible member having an attachment mechanism for connecting the first and second planar end surfaces to each other;

the fastening assembly further comprised of a sleeve, where the sleeve is placed around the flexible member;

where the fastening assembly is configured to encompass and detachably hold together various groupings of products.

2. The fastening assembly of claim 1, where the attachment mechanism is selected from a group consisting of hook and loop ends and magnets.

3. The fastening assembly of claim 1 or 2, where the fastening assembly is further comprised of a means for venting air into and out of the flexible member, for expansion and collapsing of the fastening assembly.

4. The fastening assembly of claim 3, where the means for venting air is end caps on the corrugated tube, and where the end caps have holes.

5. The fastening assembly of claim 3, where the means for venting air is holes in the flexible member.

6. The fastening assembly of claim 3, where the means for venting air is end caps on the corrugated tube, where the end caps have holes, and where the fastening assembly is further comprised of a sleeve, where the sleeve is placed around the flexible member.

7. The fastening assembly of claim 3, where the means for venting air is holes in the flexible member, and where the fastening assembly is further comprised of a sleeve, where the sleeve is placed around the flexible member.

8. The fastening assembly of claim 3, where the means for venting air is end caps on the corrugated tube, where the end caps have holes, and where the fastening assembly is further comprised of a sterile sleeve, where the sleeve is placed around the flexible member.

9. The fastening assembly of claim 3, where the means for venting air is holes in the flexible member, and where the fastening assembly is further comprised of a sterile sleeve, where the sleeve is placed around the flexible member.

* * * * *